US006316402B1

(12) United States Patent
Baker et al.

(10) Patent No.: US 6,316,402 B1
(45) Date of Patent: Nov. 13, 2001

(54) FABRIC SOFTENING COMPOSITIONS

(75) Inventors: Ellen Schmidt Baker, Cincinnati, OH (US); Lily Deforce, Leuven (BE); Frederick Anthony Hartman, Cincinnati, OH (US); Bruno Albert Jean Hubesch, Leefdaal; Axel Masschelein, Brussels, both of (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/194,859

(22) PCT Filed: Jun. 2, 1997

(86) PCT No.: PCT/US97/09483

§ 371 Date: May 27, 1999

§ 102(e) Date: May 27, 1999

(87) PCT Pub. No.: WO97/46650

PCT Pub. Date: Dec. 11, 1997

(51) Int. Cl.[7] ..... C11D 1/835
(52) U.S. Cl. ..... 510/516; 510/520; 510/522
(58) Field of Search ..... 510/516, 520, 510/522

(56) References Cited

U.S. PATENT DOCUMENTS

| | | | | |
|---|---|---|---|---|
| 3,984,335 | | 10/1976 | Ciko et al. | 252/8.6 |
| 5,019,281 | | 5/1991 | Singer et al. | 252/8.8 |
| 5,728,673 | * | 3/1998 | Mermelstein et al. | 510/475 |
| 5,789,373 | * | 8/1998 | Baker et al. | 510/522 |
| 5,830,843 | * | 11/1998 | Hartman et al. | 510/475 |

FOREIGN PATENT DOCUMENTS

| | | | |
|---|---|---|---|
| 0 044 003 | 1/1982 | (EP) | C11D/1/835 |

* cited by examiner

*Primary Examiner*—John Hardee
(74) *Attorney, Agent, or Firm*—Frank C. Turner; Steve W. Miller; Kim W. Zerby

(57) ABSTRACT

The present invention relates to fabric softening compositions and methods thereof which effectively reduces the amount of dyes released from coloured fabrics upon wet treatment, said composition comprising one or more cationic fabric softener components having at least two long chains, one or more dispersible polyolefins and one or more cationic dye fixing agents.

13 Claims, No Drawings

FABRIC SOFTENING COMPOSITIONS

FIELD OF THE INVENTION

The present invention relates to fabric softening compositions and more particularly to compositions which reduce the amount of dyes released from coloured fabrics upon wet treatment such as those which occur in a laundry operation.

BACKGROUND OF THE INVENTION

The domestic treatment of coloured fabrics is a problem known in the art to the formulator of laundry compositions. More particularly, the problem of formulating laundry compositions which reduce the amount of dyes released from coloured fabrics upon wet treatment is a particular challenge to the formulator. This problem is now even more acute with the trends of consumer to move towards more colored fabrics.

Numerous solutions have been proposed in the art to solve this problem such as by treating the fabric with a dye scavenger during the washing process as described in EP 0,341,205, EP 0,033,815 and with a polyvinyl substance as described in WO 94/11482 or in the rinse cycle with a dye fixing agent as described in EP 0,462,806. However, a problem encountered with these solutions is that the dye fixing agents when used in the washing process may be destroyed or damaged by contact on storage and/or during the process, whilst when used in the rinse cycle the need for high level of dye fixing agents is required to provide effective dye fixation performance. By high levels of dye fixing agents is meant levels above at least 5% by weight and more especially above 10% by weight of the softening compositions. Furthermore, a problem related with the use of dye fixing agents in a softening composition is that of its weight efficiency. So that, although levels of dye fixing agents above 10% by weight would provide effective dye fixation, such use would result in an increase in the formulation cost. Another problem related to the use of a high level of dye fixing agents in liquid fabric softening compositions is that the resulting products show phase instability. On the other hand, lowering the level of dye fixing agents would not provide sufficient dye fixing properties.

Accordingly, notwithstanding the advances in the art, there is still a need for a composition which effectively reduces the amount of dyes released from coloured fabrics upon wet treatment .

The Applicant has now found that the use of a dispersible polyolefin in a fabric softener composition comprising one or more cationic fabric softener component having at least two long chains and one or more cationic dye fixing agent overcomes the problem.

An advantage of the invention is that the use of said dispersible polyolefin, even when preferably present in a low amount such as from 0.1% to 3% by weight, in a fabric softener composition comprising one or more cationic fabric softener component having at least two long chains and one or more cationic dye fixative agents allows the use of a lower amount of cationic dye fixative agent while still not being detrimental to the dye fixing performance of the composition.

It is therefore an advantage of the invention to provide fabric softening compositions which provide effective reduction of the amount of dyes released from coloured fabrics upon wet domestic treatments.

It is another advantage of the invention to provide fabric softening compositions with effective softening properties.

It is a further advantage of the invention to provide liquid fabric softening compositions which show effective storage stability.

SUMMARY OF THE INVENTION

The present invention relates to a fabric softening composition comprising one or more cationic fabric softener components having at least two long chains, one or more dispersible polyolefins and one or more cationic dye fixing agents.

In a preferred embodiment of the invention, said dye fixing agents are present in amount of less than 5% by weight.

In accordance with another aspect of the present invention, methods for treating fabrics are provided. One method comprises tumble drying the fabrics with a dryer-sheet onto which a fabric softening composition of the invention has been applied. Another method comprises contacting the fabrics during the rinse cycle of a consumer laundry process with an aqueous medium containing at least 50 ppm of a fabric softening composition of the invention.

DETAILED DESCRIPTION OF THE INVENTION

Cationic Fabric Softeners

An essential component of the invention is one or more cationic fabric softener components having at least two long chains. By component having at least two long chains is meant a component containing at least two alkyl or alkenyl chains, each comprising from 10 to 25 carbon atoms. Such fabric softener provides effective softness benefit to the treated fabrics.

Typical levels of said fabric softener components within the liquid softener compositions are from 1% to 99% by weight of the compositions. Depending on the composition execution which can be dilute with a preferred level of fabric softening components from 1% to 5%, or concentrated, with a preferred level of fabric softening components from 5% to 80%, more preferably 10% to 50%, most preferably 15% to 35% by weight.

Where the fabric softener composition is applied on a substrate such as a dryer-sheet, the preferred level of fabric softener components will preferably be from 20% to 99%, more preferably from 30% to 90% by weight, and even more preferably from 35% to 80% by weight.

Typical cationic fabric softening components having at least two long chains include the water-insoluble quaternary-ammonium fabric softening actives, the most commonly used having been di-long alkyl chains ammonium chloride.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;

12) ditallow imidazolinium methylsulfate;

13) 1-(2-tallowyca midoethyl)-2-tallowyl imidazolinium methylsulfate.

However, in recent years, the need has arisen for more environmental-friendly materials, and rapidly biodegradable quaternary ammonium compounds have been presented as alternatives to the traditionally used di-long chain ammonium chlorides. Such quaternary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

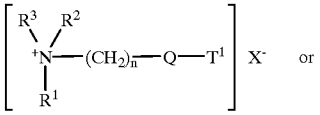

or (II)

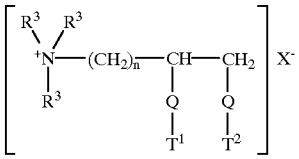

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;

2) N,N-di(tallowyl-oxy-ethyl)-N-methyl, N-(2-hydroxyethyl) ammonium chloride;

3) N,N-di(2-tallowyl-oxy-2-oxo-ethyl)-N,N-dimethyl ammonium chloride;

4) N,N-di(2-tallowyl-oxy-ethylcarbonyl-oxy-ethyl)-N,N-dimethyl ammonium chloride;

5) N-(2-tallowyl-oxy-2-ethyl)-N-(2-tallowyl-oxy-2-oxo-ethyl)-N,N-dimethyl ammonium chloride;

6) N,N,N-tri(tallowyl-oxy-ethyl)-N-methyl ammonium chloride;

7) N-(2-tallowyl-oxy-2-oxo-ethyl)-N-(tallowyl-N,N-dimethyl-ammonium chloride;

8) N-methyl-N-(3-tallowamidopropyl),N-(2-tallowoyloxyethyl) ammonium chloride;

9) 1,2-ditallowyl-oxy-3-trimethylammoniopropane chloride; and mixtures of any of the above materials.

Of these, compounds 1–8 are examples of compounds of Formula (I); compound 9 is a compound of Formula (II). Particularly preferred is N,N-di(tallowyl-oxy-ethyl)-N,N-dimethyl ammonium chloride, where the tallow chains are at least partially unsaturated. The level of unsaturation of the tallow chain c an be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having an IV of from 5 to 25, preferably 15 to 20, it has been found that a cis/trans isomer weight ratio greater than 30/70, preferably greater than 50/50 and more preferably greater than 70/30 provides optimal concentrability. For compounds of Formula (I) made from tallow fatty acids having an IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the pH values.

For the preceding biodegradable fabric softening agents, the pH of the compositions herein is an essential parameter of the present invention. indeed, it influences the stability of the quaternary ammonium or amine precursors compounds, especially in prolonged storage conditions.

The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a diluted form, the pH of the neat composition is in the range of 2.0 to 3.0. The pH of these compositions herein can be regulated by the addition. of a Bronsted acid. Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Dispersible Polyolefin

Another essential component of the invention is one or more dispersible polyolefins. Preferably, the polyolefin is a polyethylene, polypropylene or mixtures thereof. The polyolefin may be at least partially modified to contain various functional groups, such as carboxyl, carbonyl, ester, ether, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the polyolefin is preferably introduced as a suspension or an emulsion of polyolefin dispersed by use of an emulsifing agent. The polyolefin suspension or emulsion preferably has from 1 to 50%, more preferably from 10 to 35% by weight, and most preferably from 15 to 30% by weight of polyolefin in the emulsion. The polyolefin preferably has a molecular weight of from 1,000 to 15,000 and more preferably from 4,000 to 10,000.

When an emulsion is employed, the emulsifier may be any suitable emulsification or suspending agent. Preferably, the emulsifier is a cationic, nonionic, zwitterionic or anionic surfactant or mixtures thereof. Most preferably, any suitable cationic, nonionic or anionic surfactant may be employed as the emulsifier. Preferred emulsifiers are cationic surfactants such as the fatty amine surfactants and in particular the ethoxylated fatty amine surfactants. In particular, the cationic surfactants are preferred as emulsifiers in the present invention. The polyolefin is dispersed with the emulsifier or suspending agent in a ratio of emulsifier to polyolefin of from 1:10 to 3:1. Preferably, the emulsion includes from 0.1 to 50%, more preferably from 1 to 20% and most preferably from 2.5 to 10% by weight of emulsifier in the polyolefin emulsion. Polyethylene emulsions and suspensions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

The compositions of the present invention contain from 0.01% to 8% by weight of the dispersible polyolefin. More preferably, the compositions include from 0.1% to 5% by weight and most preferably from 0.1% to 3% by weight of the polyolefin. When the polyolefin is added to the compositions of the present invention as an emulsion or suspension, the emulsion or suspension is added at sufficient enough quantities to provide the above noted levels of dispersible polyolefin in the compositions.

Cationic Dye Fixing Agents

The other essential component of the invention is one or more cationic dye fixative agents. Cationic dye fixing agents, or "fixatives", are well-known, commercially available materials which are designed to improve the appearance of dyed fabrics by minimizing the loss of dye from fabrics due to washing but which are not fabric softeners. Cationic dye fixatives are based on various quaternized or otherwise cationically charged organic nitrogen compounds. Cationic fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; poiyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH and Tinofix® ECO available from Ciba-Geigy.

Other cationic dye fixing agents are described in "After treatments for improving the fastness of dyes on textile fibres" by Christopher C. Cook (REV. PROG. COLORATION Vol. 12, 1982). Dye fixing agents suitable for use in the present invention are ammonium compounds such as fatty acid-diamine condensates e.g. the hydrochloride, acetate, metosulphate and benzyl hydrochloride of oleyldiethyl aminoethylamide, oleylmethyldiethylenediaminemethosulphate, monostearyi-ethylene diaminotrimethylammonium methosuephate and oxidized products of tertiary amines; derivatives of polymeric alkyldiamines, polyamine-cyanuric chloride condensates and aminated glycerol dichlorohydrins.

A typical amount of dye fixing agent to be employed in the composition of the invention is preferably from 0.001% to 10% by weight o f the composition.

Advantageously, the use of the dispersible polyolefin, even when present in amount as low as 0.1% to 3% allows the use of lower dye fixative levels without compromising on the dye fixing performance of the composition. Accordingly, lower levels of dye fixing agents are permitted; such levels are preferably from 0.1% to 5% by weight, most preferably from 0.5% to 2.5% by weight of the composition.

A further advantage to this lowering of dye fixatives levels is the resulting better weight efficiency due to the reduction in the formulation cost.

Another advantage of the invention is that of the stabilisation of the fabric softener containing dye fixing agents by the use of the dispersible polyolefin.

Additional Components

The composition may also optionally contain additional components such as enzymes, additional fabric softener materials, surfactant concentration aids, electrolyte concentration aids, stabilisers, such as well-known antioxidants and reductive agents, soil release polymers, emulsifiers, bacteriocides, colorants, perfumes, preservatives, optical brighteners, anti ionisation agents, antifoam agents and chelating agents.

Enzymes

The composition herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. .U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. Other suitable cellulases are also A-0,739,982.

In practical terms for current commercial preparations, typical amounts are up to about 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Additional Fabric Softener Materials

Additional fabric softening materials may be used in addition to the cationic fabric softener. These may be selected from nonionic, amphoteric or anionic fabric softening materials. Disclosure of such materials may be found in U.S. Pat. No. 4,327,133; U.S. Pat. No. 4,421,792; U.S. Pat. No. 4,426,299; U.S. Pat. No. 4,460,485; U.S. Pat. No. 3,644,203; U.S. Pat. No. 4,661,269; U.S. 4,439,335; U.S. 3,861,870; U.S. Pat. No. 4,308,151; U.S. Pat. No. 3,886,075; U.S. Pat. No. 4,233,164; U.S. Pat. No. 4,401,578; U.S. Pat. No. 3,974,076; U.S. Pat. No. 4,237,016 and EP 472,178.

Typically, such nonionic fabric softener materials have an HLB of from 2 to 9, more typically from 3 to 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms.

Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between 10:1 and 1:10, and 15-sorbitan esters are also useful.

Glycerol and polyglycerol esters, especially glycerol, diglycerol, triglycerol, and polyglycerol mono- and/or di-esters, preferably mono-, a re preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Surfactant Concentration Aids

Surfactant concentration aids may also optionally be used. Surfactant concentration aids are typically selected from single long chain alkyl cationic surfactants, nonionic surfactants, amine oxides, fatty acids, and mixtures thereof, typically used at a level of from 0 to 15% of the composition.

Single Long Chain Alkyl Cationic Surfactants

Such mono-long-chain-alkyl cationic surfactants useful in the present invention are, preferably, quaternary ammonium salts of the general formula:

$$[R^2N{+}R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from 0.1% to 20% by weight of the softener active. Each $R^3$ is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

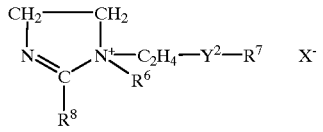

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from $R^3$ and $R^2$ as defined hereinbefore for the single-long-chain cationic surfactant with only one being $R^2$.

Some alkyl pyridinium salts useful in the present invention have the general formula:

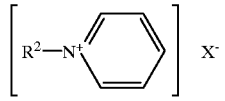

wherein $R^2$ and $X^-$ are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from 7 to 20, preferably from 8 to 15.

Examples of particularly suitable nonionic surfactants include

Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyidodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 10 to 25, preferably from 12 to 25 total carbon atoms, with the fatty moiety containing from 10 to 22, preferably from 16 to 22, carbon atoms. The shorter moiety contains from 1 to 4, preferably from 1 to 2 carbon atoms. The level of unsaturation of the tallow chain can be measured by the Iodine Value (IV) of the corresponding fatty acid, which in the present case should preferably be in the range of from 5 to 100, more preferably in the range of from 0 to 25.

Specific examples of fatty acid compounds suitable for use in the aqueous fabric softening compositions herein include compounds selected from lauric acid, myristic acid, palmitic acid, stearic acid, arachidic acid, behenic acid, oleic acid, coconut fatty acid, tallow fatty acid, partially hydrogenated tallow fatty acid and mixtures thereof. A most preferred fatty acid compound is tallow fatty acid with an Iodine Value (IV) of 18.

Electrolyte Concentration Aids

Inorganic viscosity control agents which can also act like or augment the effect of the surfactant concentration aids, include water-soluble, ionizable salts which can also optionally be incorporated into the compositions of the present invention. Incorporation of these components to the composition must be processed at a very slow rate.

A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilise the viscosity over a broader range of temperature, especially at low temperatures, compared to the inorganic electrolytes.

Specific examples of alkylene polyammonium salts include I-lysine monohydrochioride and 1,5-diammonium 2-methyl pentane dihydrochloride.

Another ingredient is a liquid carrier. Suitable liquid carriers are selected from water, organic solvents and mixtures thereof. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Form of the Composition

The fabric softening composition can take a variety of physical forms including liquid such as aqueous or non-aqueous compositions and solid forms such as solid particulate forms. Preferably, the present composition is in a liquid form.

Such compositions may be applied onto a substrate such as a dryer sheet product, used as a rinse added product, or as a spray or foam product. Preferably, the present composition is in a rinse added form.

The compositions of the invention can be added directly in the rinse both to provide adequate usage concentration, e.g., at least 50 ppm and more preferably from 100 to 10,000 ppm of the liquid rinse added fabric softener compositions of the present invention.

Accordingly, a method is provided for treating fabrics comprising contacting said fabrics in the rinse cycle with an aqueous medium containing at least 50 ppm, preferably from 100 to 10,000 ppm of the liquid fabric softening composition of the invention.

Process

The fabric softening composition can conveniently be made according to well-known processes to the skilled person. An exemplary disclosure is given in EP-A-0,668, 902.

The invention is illustrated in the following non-limiting examples, in which all percentages are on a weight basis unless otherwise stated.

In the examples, the abbreviated component identifications have the following meanings:

DEQA: Di-(tallowoyl-oxy-ethyl) dimethyl ammonium chloride

Fatty acid: Stearic acid of IV=18

Electrolyte: Calcium chloride

PEG: Polyethylene Glycol MW 4000

Velustrol® PKS: Cationic polyethylene emulsion available from HOECHST Aktiengesellschaft Carezyme: cellulytic enzyme sold by NOVO Industries A/S

EXAMPLE 1

The following fabric softening composition according to the present invention was prepared:

| Component | A |
|---|---|
| DEQA | 19.0 |
| Hydrochlorid acid | 0.02 |
| Soil Release Polymer | 0.02 |
| PEG | 0.6 |
| Perfume | 1.0 |
| Electrolyte | 600 ppm |
| Dye | 50 ppm |
| Sandofix ® TPS | 1.0 |
| Velustrol ® PKS | 2.6 |

Water and minors to balance to 100%

EXAMPLE 2

The following fabric softening compositions are in accordance with the invention:

| Component | B | C | D |
|---|---|---|---|
| DEQA | 2.6 | 2.9 | 18.0 |
| Fatty acid | 0.3 | — | 1.0 |
| Hydrochlorid acid | 0.02 | 0.02 | 0.02 |
| Soil Release Polymer | — | — | 0.02 |
| PEG | — | — | 0.6 |
| Perfume | 1 | 0.5 | 1 |
| Electrolyte | — | — | 600 ppm |
| Dye | 10 ppm | 10 ppm | 50 ppm |
| Sandofix ® TPS | 0.3 | 0.3 | 1.0 |
| Velustrol ® PKS | 0.8 | 0.8 | 2.6 |
| Carezyme CEVU/g of composition | — | — | 50 |

Water and minors to balance to 100%

What is claimed is:

1. A fabric softening composition comprising one or more cationic fabric softener components having at least two long chains, one or more dispersible polyolefins present in an amount above 0% and less than about 3% and one or more cationic dye fixing agents present in an amount above 0% and less than about 5%.

2. A fabric softening composition according to claim 1, wherein said fabric softener is a biodegradable cationic fabric softener selected from quaternary ammonium compounds and amine precursors having the formula (I) or (II), below:

(I)

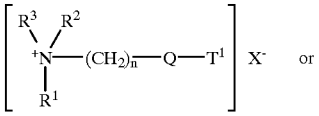

or

-continued (II)

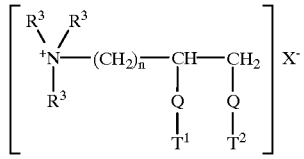

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

3. A fabric softening composition according to claim 1, wherein said fabric softener is present in amount of 1% to about 99% by weight.

4. A fabric softening composition according to claim 1, wherein said dispersible polyolefin is added as an emulsion or suspension of polyolefin.

5. A fabric softening composition according to claim 1, wherein said dispersible polyolefin is a polyethylene.

6. A fabric softening composition according to claim 1, wherein said polyethylene is an oxidised polyethylene.

7. A fabric softening composition according to claim 1, wherein said polyolefin is dispersed with an emulsifier selected from the group consisting of a cationic, anionic or nonionic surfactant.

8. A fabric softening composition according to claim 1, wherein said dye fixing agent is a polycationic dye fixing agent.

9. A fabric softening composition according to claim 1, wherein said composition further comprises an enzyme.

10. A fabric softening composition according to claim 9, wherein said enzyme is a cellulase.

11. A fabric softening composition according to claim 1, wherein said fabric softening composition is a liquid composition.

12. A method for treating fabrics comprising tumble drying said fabrics with a dryer-sheet onto which a fabric softening composition comprising one or more cationic fabric softener components having at least two long chains, one or more dispersible polyolefins present in an amount above 0% and less than about 3% and one or more cationic dye fixing agents present in an amount above 0% and less than about 5% has been applied.

13. A method for treating fabrics comprising contacting said fabrics in the rinse cycle with an aqueous medium containing at least 50 ppm of a liquid fabric softening composition comprising one or more cationic fabric softener components having at least two long chains, one or more dispersible polyolefins present in an amount above 0% and less than about 3% and one or more cationic dye fixing agents present in an amount above 0% and less than about 5%.

* * * * *